US007510375B2

(12) United States Patent
Toppen et al.

(10) Patent No.: US 7,510,375 B2
(45) Date of Patent: Mar. 31, 2009

(54) METHOD OF COATING AND A SHIELD FOR A COMPONENT

(75) Inventors: Harvey R. Toppen, Glastonbury, CT (US); Dean N. Marszal, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 335 days.

(21) Appl. No.: 11/028,880

(22) Filed: Jan. 4, 2005

(65) Prior Publication Data

US 2006/0147300 A1 Jul. 6, 2006

(51) Int. Cl.
*F01D 5/14* (2006.01)

(52) U.S. Cl. ..... 416/62; 416/224; 416/247 R

(58) Field of Classification Search ..... 416/62, 416/247 R

See application file for complete search history.

(56) References Cited

U.S. PATENT DOCUMENTS

| | | | | |
|---|---|---|---|---|
| 3,675,363 | A * | 7/1972 | Mills | 446/109 |
| 5,034,576 | A * | 7/1991 | Dalebout et al. | 200/43.04 |
| 5,225,246 | A | 7/1993 | Beers et al. | |
| 5,565,035 | A * | 10/1996 | Sylvestro et al. | 118/721 |
| 5,985,122 | A | 11/1999 | Conner | |
| 6,258,226 | B1 * | 7/2001 | Conner | 204/279 |
| 6,273,676 | B1 * | 8/2001 | Brooks et al. | 415/191 |

FOREIGN PATENT DOCUMENTS

| | | |
|---|---|---|
| EP | 0 908 538 | 4/1999 |
| EP | 908538 | 4/1999 |
| EP | 0 925 845 | 6/1999 |
| EP | 0 965 391 | 12/1999 |
| EP | 1094200 | 4/2001 |
| EP | 1 116 523 | 7/2001 |
| JP | 9-512604 | 12/1997 |
| JP | 11-158684 | 6/1999 |
| JP | 2000-34902 | 2/2000 |
| WO | 9530069 | 11/1995 |

OTHER PUBLICATIONS

United Kingdom Search Report dated Apr. 5, 2006.
Japanese Office Action dated Jun. 26, 2008.

* cited by examiner

*Primary Examiner*—Richard Edgar
(74) *Attorney, Agent, or Firm*—Carlson, Gaskey & Olds

(57) ABSTRACT

A gas turbine engine is used for power generation or propulsion and includes vanes. Each vane includes a trailing edge having a curvature and cooling slots that cool the vane. A photochemical edge shield includes an edge and projections that project from the edge. Before coating the vane, the photochemical edge shield is positioned on the vane such that each of the projections is received in one of the cooling slots. A ceramic coating is then applied to the vane. The photochemical edge shield prevents the ceramic coating from entering and clogging the cooling slots of the vane during the ceramic coating process.

17 Claims, 5 Drawing Sheets

METHOD OF COATING AND A SHIELD FOR A COMPONENT

BACKGROUND OF THE INVENTION

The present invention relates generally to a method of coating and a shield for a component. In particular, the present invention relates to a photochemical edge shield that protects, for example, cooling slots of a vane of a gas turbine engine during a ceramic coating process.

A gas turbine engine includes alternating rows of rotary airfoils or blades and stationary airfoils or vanes. Each vane includes cooling slots that allow air to enter and cool the vane during use. The vanes are usually made of nickel superalloy and are commonly coated with a ceramic coating to provide a thermal barrier.

During the ceramic coating process, the ceramic coating can flow into and clog the cooling slots. If this occurs, the cooling effect of the cooling slots can decrease. A shield has been employed to cover the cooling slots and prevent the ceramic coating from entering the cooling slots during ceramic coating process. The shield of the prior art includes two projections that each fit into a corresponding slot in the airfoil to locate the shield relative to the airfoil. The projections are located at opposite ends of the shield, and a curved edge extends between the projections.

The airfoil is also commonly masked before coating to prevent the coating from flowing into the cooling slots. A grit blasting step is then employed after coating to remove any ceramic residue in the cooling slots.

A drawback to conventional shields is that the ceramic coating can leak around the shield and possibly flow into the cooling slots. Additionally, the steps of masking and grit blasting are costly. Finally, the shield does not include any feature to secure the shield relative to the airfoil.

Hence, there is a need in the art for a shield that prevents a ceramic coating from flowing into cooling slots of a vane of a gas turbine engine during a ceramic coating process and that overcomes the drawbacks and shortcomings of the prior art.

SUMMARY OF THE INVENTION

A gas turbine engine is used for power generation or propulsion. The gas turbine engine includes alternating rows of rotary airfoils or blades and static airfoils or vanes. Each vane includes a trailing edge having a curvature and cooling slots. During use, the vane becomes very hot, and the cooling slots allow air to enter and cool the vane. The vane is made of a nickel superalloy and is coated with a ceramic coating to provide a thermal barrier.

A photochemical edge shield is positioned on the vane before the ceramic coating process to prevent the ceramic coating from flowing into and clogging the cooling slots. The photochemical edge shield includes an edge having a curvature and projections that project from the edge. The edge of the photochemical edge shield has substantially the same shape and curvature as the trailing edge of the vane. The number of projections is equal to the number of cooling slots.

A top surface of the photochemical edge shield is substantially planar and flat, and a bottom surface of the photochemical edge shield includes a recessed edge. The curvature of the recessed edge is approximately equal to the curvature of the edge of the photochemical edge shield. A recessed space defined between the each of the projections extends between the edge and the recessed edge. The photochemical edge also includes a fold over flap separated from a body by a fold line having a reduced thickness.

Before coating the vane, the photochemical edge shield is positioned on the vane such that the bottom surface contacts the vane and each of the projections is received in one of the cooling slots.

The photochemical edge shield is then bent at the fold line such that the fold over flap is located under the vane. The photochemical edge shield is then tack welded to secure the photochemical edge shield to the vane. After the ceramic coating process is completed, the photochemical edge shield is removed from the vane.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
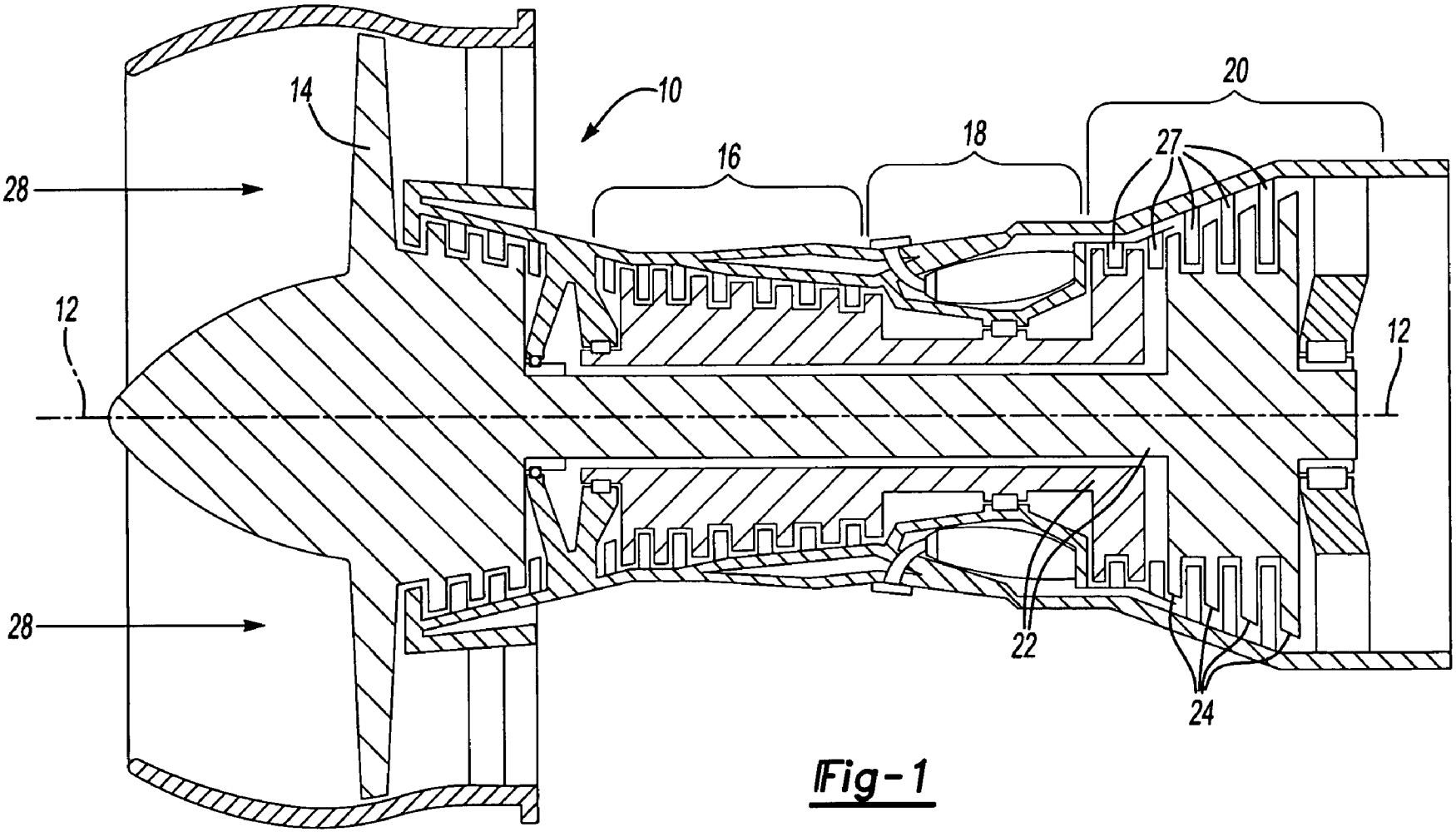
FIG. 1 illustrates one embodiment of a gas turbine engine.

FIG. 1 schematically illustrates a gas turbine engine 10 used for power generation or propulsion. The gas turbine engine 10 includes an axial centerline 12, a fan 14, a compressor section 16, a combustion section 18 and a turbine 20. Air compressed in the compressor section 16 is mixed with fuel, burned in the combustion section 18 and expanded in the turbine 20. The air compressed in the compressor section 16 and the fuel mixture expanded in the turbine 20 are both referred to as a hot gas stream flow 28. Rotors 22 of the turbine 20 rotate in response to the expansion and drive the compressor section 16 and the fan 14. The turbine 20 also includes alternating rows of rotary airfoils or blades 24 on the rotors 22 and static airfoils or vanes 27. The vanes 27 could be made of a base metal of nickel superalloy.

Figure 2:
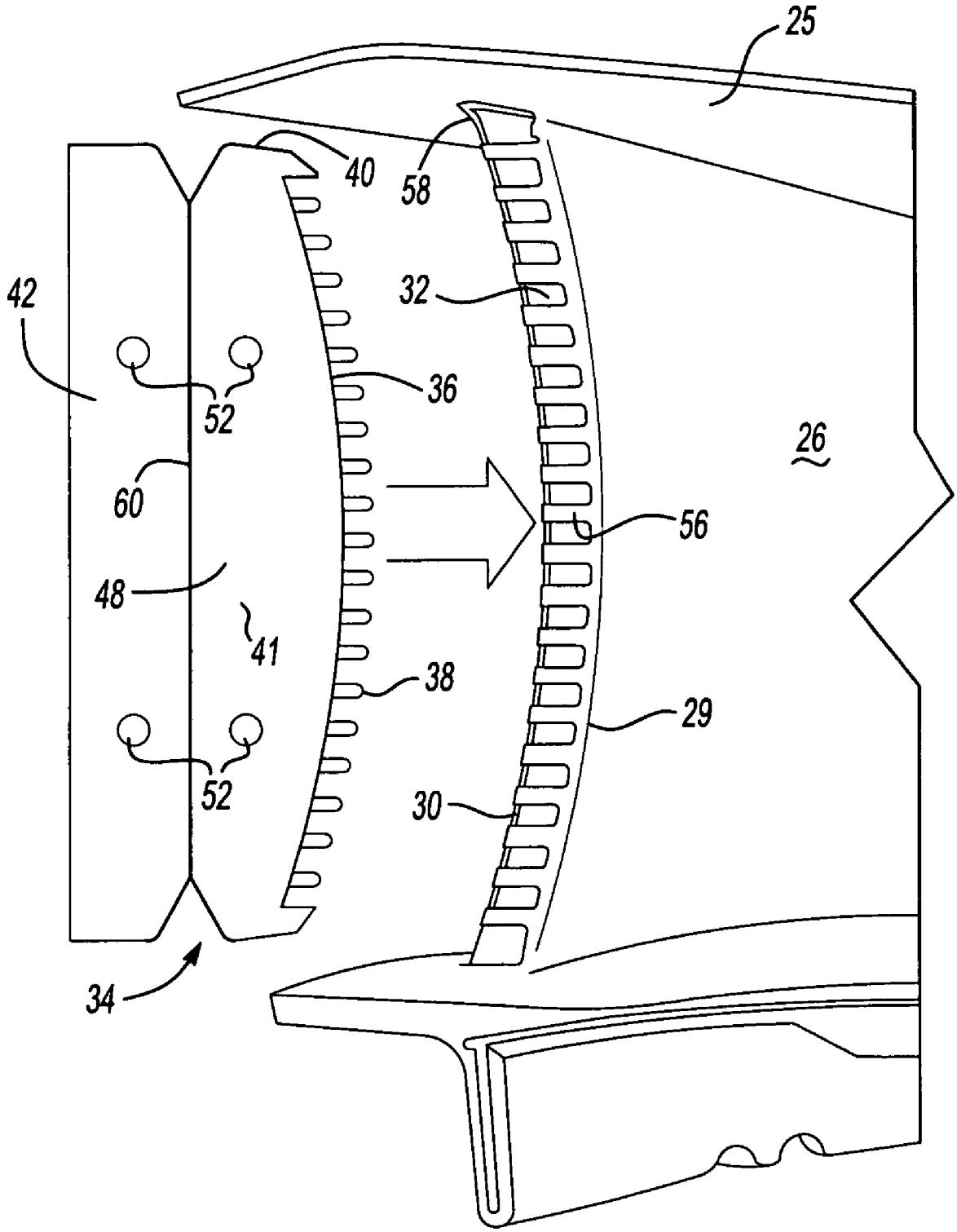
FIG. 2 illustrates one embodiment of a portion of a vane assembly of the gas turbine engine.

FIG. 2 illustrates a portion of a vane assembly. The vane assembly can include an airfoil section 26 extending between one or more platforms 25. The vane assembly includes one or more interior passageways (not shown). The airfoil section 26 includes a trailing edge 30 having a curvature and cooling slots 32 on the pressure side of the airfoil section 26. The cooling slots 32 communicate with the interior passageways. Each cooling slot 32 is separated by a wall 56. A back edge 29 is located behind the cooling slots 32. During use, the vane assembly becomes very hot. Bleed air (typically drawn from the relatively cooler compressor section 16) is provided to the interior passageways to cool the vane assembly. The cooling slots 32 allow the bleed air within the interior passageways to exit the vane assembly and to merge with the core airflow.

The gas path section of the airfoil section 26 is coated with a ceramic coating to provide a thermal barrier. The ceramic coating has a low thermal conductivity and provides heat protection. During application of the ceramic coating, whether during original manufacture or during a subsequent repair operation, the cooling slots 32 can become clogged.

Figure 3:
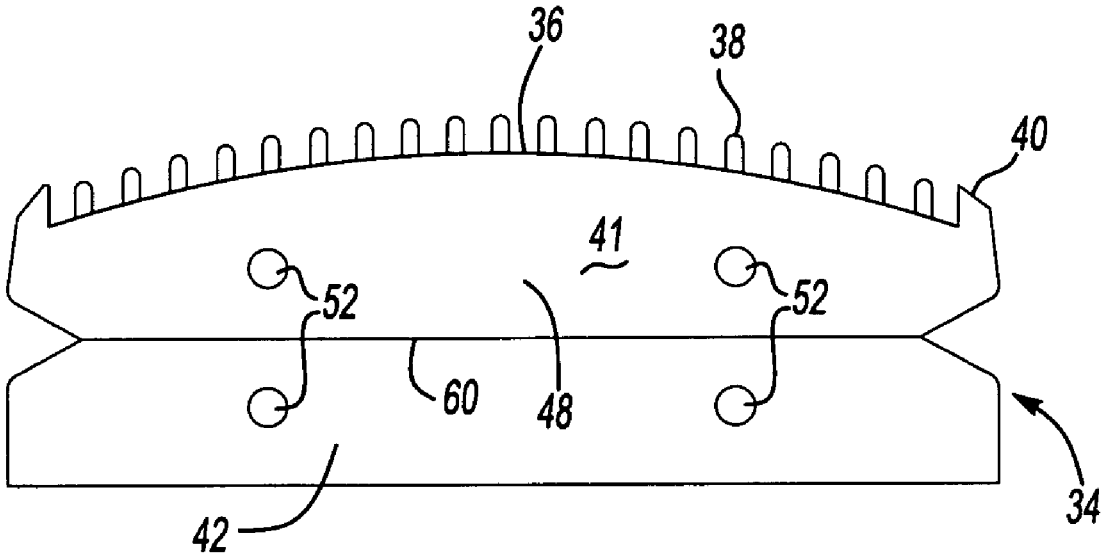
FIG. 3 illustrates a top view of one embodiment of a photochemical edge shield.
Figure 4:
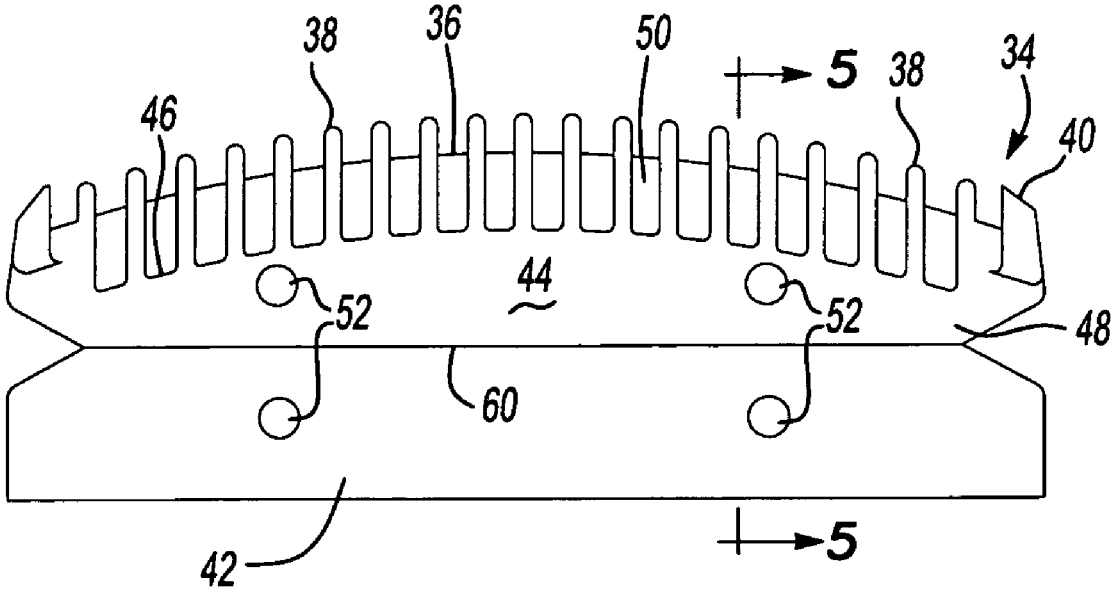
FIG. 4 illustrates a bottom view of the photochemical edge shield of FIG. 3.

FIGS. 3 and 4 illustrate a photochemical edge shield 34 that is positioned on the airfoil section 26 to protect the cooling slots 32 during the ceramic coating process and to prevent the ceramic coating from flowing into and clogging the cooling slots 32. The photochemical edge shield 34 includes a body 48 having an edge 36 that conforms to the shape of the airfoil section 26 of the vane assembly. Specifically, the edge 36 of the photochemical edge shield 34 is curved since the trailing edge 30 of the airfoil section 26 is curved.

The body 48 also includes projections 38 extending from the edge 36. Each of the projections 38 corresponds to a respective cooling slot 32 in the airfoil section 26. Accordingly, each projection 38 conforms to the shape of the respective cooling slot 32. The ends of each projection 38 could be substantially curved or semi-circular in shape. A locating arm 40 on each end of the photochemical edge shield 34 inserts into an opening 58 in the airfoil section 26 to ensure that the photochemical edge shield 34 is properly aligned with the airfoil section 26.

The photochemical edge shield 34 can be made of various materials. For example, the photochemical edge shield 34 can be made of stainless steel, brass or copper. However, the photochemical edge shield 34 can be made of any material, and one skilled in the art would know what materials to employ.

Figure 5:
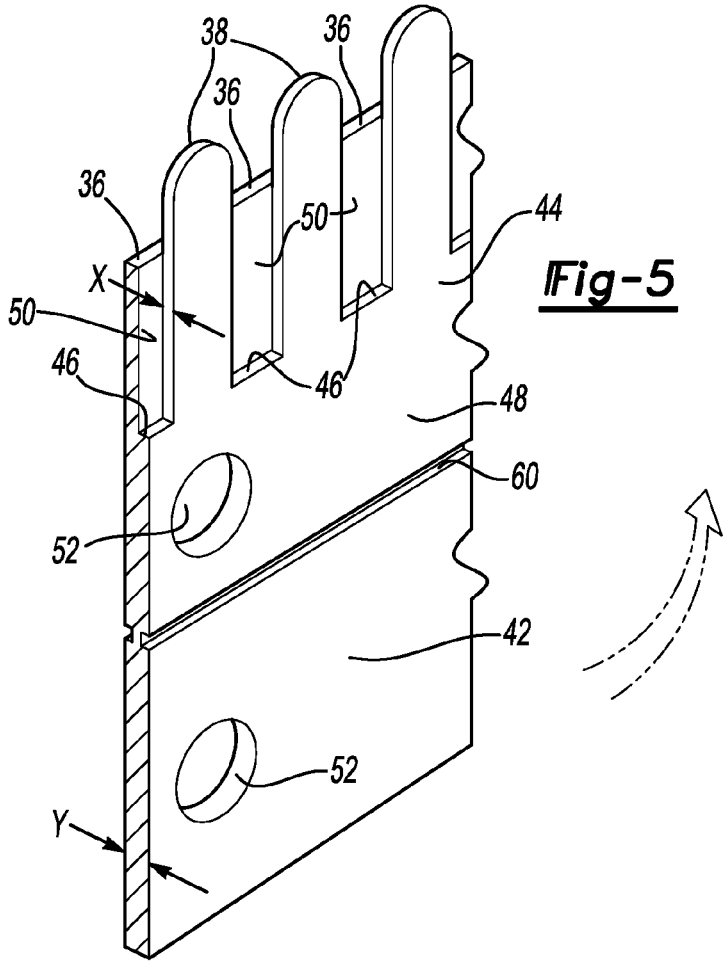
FIG. 5 illustrates a perspective view of the photochemical edge shield of FIG. 3.

As shown in FIG. 3, a top surface 41 of the photochemical edge shield 34 could be substantially planar, continuous and flat. That is, the top surface 41 does not include any recessed spaces. As shown in FIG. 4, the bottom surface 44 of the photochemical edge shield 34 includes a recessed edge 46. The curvature of the recessed edge 46 is approximately equal to the curvature of the edge 36. On the bottom surface 44, a recessed space 50 is defined between adjacent projections 38, and each recessed space 50 extends between the edge 36 and the recessed edge 46. As shown in FIG. 5, each recessed space 50 has a thickness x, and the body 48 and the projections 38 of the photochemical edge shield 34 have a thickness y, which is greater than the thickness x. Alternately, the photochemical edge shield 34 has a constant thickness and no recessed portions between the projections 38.

The photochemical edge shield 34 can also includes a fold line 60 having a reduced thickness that separates the body 48 from a fold over flap 42. The photochemical edge shield 34 can also include one or more holes 52 that allow a fixture (not shown) to help position the photochemical edge shield 34 on the airfoil section 26 of the vane assembly before the ceramic coating process begins. For example, the fixture can help control the depth that the projections 38 enter the cooling slots 32 of the airfoil section 26.

Figure 6:
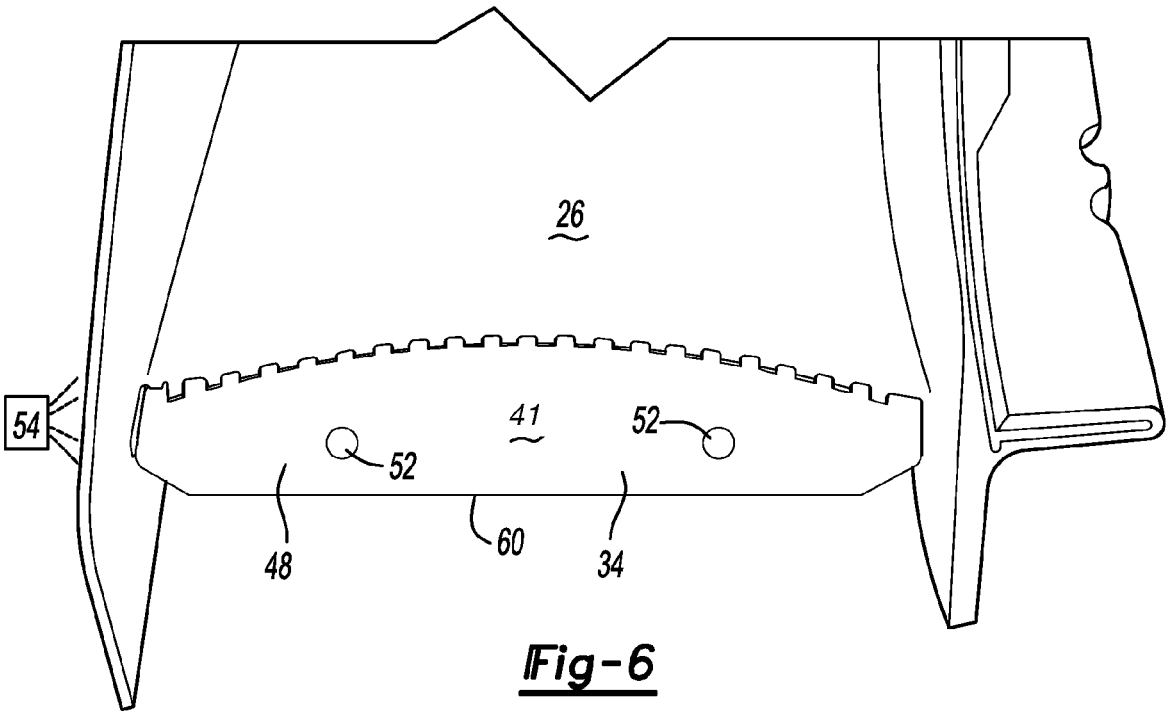
FIG. 6 illustrates a portion of the vane assembly of FIG. 2 with the photochemical edge shield of FIG. 3 positioned on the vane assembly.

Before coating the airfoil section 26 with the ceramic coating, the photochemical edge shield 34 is positioned on the airfoil section 26 as shown in FIG. 6 such that each of the projections 38 is received in a corresponding one of the cooling slots 32. Each recessed space 50 receives a corresponding one of the walls 56 that are between each of the cooling slots 32. The locating arms 40 locate the photochemical edge shield 34 relative to the airfoil section 26.

After the photochemical edge shield 34 is positioned on the airfoil section 26, the photochemical edge shield 34 is bent along the fold line 60 such that the fold over flap 42 is bent around the trailing edge 30 of the airfoil section 26 to reside on the suction side of the airfoil section 26, as shown in FIG. 6. Alternatively, the body 48 of the photochemical edge shield 34 and the fold over flap 44 can be separate components.

The photochemical edge shield 34 is then secured to the airfoil section 26 to prevent distortion during the ceramic coating process. In one example, the photochemical edge shield 34 can be secured to the airfoil section 26 by tack welding. Three to five tack welds can be employed. Alternately, the photochemical edge shield 34 can include tabs in the body 48 that can be bent inwardly to contact the airfoil section 26 and to secure the photochemical edge shield 34 to the airfoil section 26. However, any method can be used to secure the photochemical edge shield 34 to the airfoil section 26, and one skilled in the art could select which technique to use.

A sprayer 54 applies the ceramic coating to the airfoil section 26 using, for example, conventional techniques. When the ceramic coating is applied to the airfoil section 26, the projections 38 of the photochemical edge shield 34 received in the cooling slots 32 prevent the ceramic coating from entering and clogging the cooling slots 32. The contact of the recessed edge 46 of the photochemical edge shield 34 and the trailing edge 30 of the airfoil section 26 and the contact of the edge 36 of the photochemical edge shield 34 and the back edge 29 of the airfoil section 26 also provide a seal that further prevents the ceramic coating from entering the cooling slots 32. Therefore, an additional masking and grit blasting step is not needed to remove the ceramic coating from the cooling slots 32.

After the ceramic coating process is completed, the photochemical edge shield 34 is removed from the airfoil section 26. The fixture engages the holes 52 to remove the photochemical edge shield 34 from the airfoil section 26. The coating process of the present invention is less expensive than the prior art technique because the masking and grit blasting steps are not needed.

The photochemical edge shield 34 can also be coated with a coating to prevent the ceramic coating from adhering to the photochemical edge shield 34 and to prevent flaking. In one example, a coating of titanium dioxide is applied to the photochemical edge shield 34 to prevent the ceramic coating from adhering to the photochemical edge shield 34.

Figure 7:
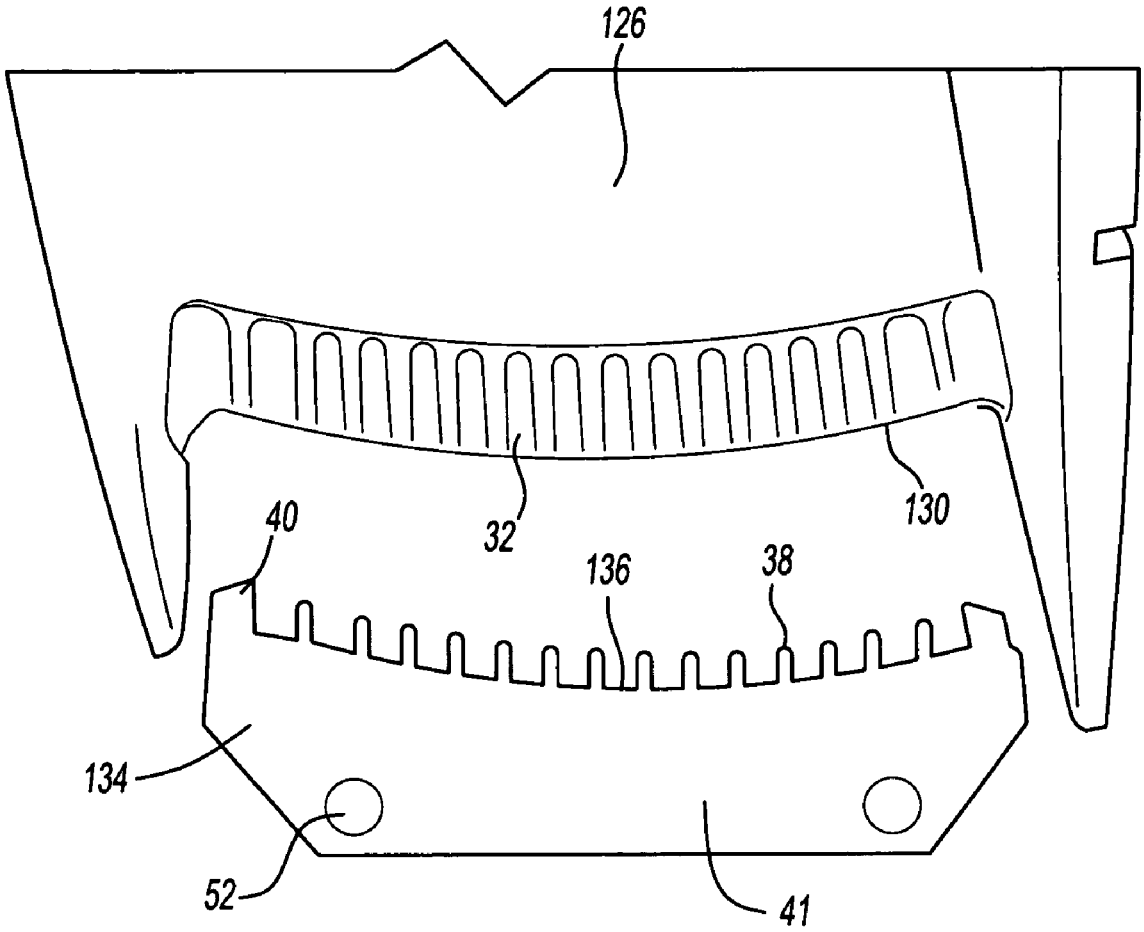
FIG. 7 illustrates another alternate embodiment of a vane and photochemical edge shield.

Alternatively, as shown in FIG. 7, the airfoil section 126 can include a trailing edge 130 with a reverse curvature. In this example, the photochemical edge shield 134 also has an edge 136 with a reverse curvature. That is, the curvatures of the trailing edge 130 and the edge 136 are substantially equal.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. An apparatus for protecting a plurality of cooling slots of an airfoil comprising:

an airfoil including a plurality of cooling slots; and a shield including a plurality of projections and a recessed portion defined between two adjacent projections, wherein a number of the plurality of cooling slots equals a number of the plurality of projections, each of the plurality of projections is received in one of the plurality of cooling slots to prevent a coating from entering the plurality of cooling slots, and the recessed portion has a recessed thickness and the shield and the projections have a shield thickness, and the recessed thickness is less than the shield thickness.

2. The apparatus as recited in claim 1 wherein the airfoil includes an airfoil edge having an airfoil edge curvature and the shield includes a shield edge having a shield edge curvature, wherein the airfoil edge curvature is substantially equal to the shield edge curvature.

3. The apparatus as recited in claim 1 wherein the coating is ceramic, the apparatus further including a sprayer that sprays the coating on the airfoil.

4. The apparatus as recited in claim 1 wherein the shield further includes a locating feature that locates the shield relative to the airfoil.

5. The apparatus as recited in claim 4 wherein the locating feature is a locating arm, and the locating arm is larger than each of the plurality of projections.

6. The apparatus as recited in claim 1 wherein the shield further includes a shield edge, a recessed edge, and each recessed portion is defined between the shield edge, the recessed edge, and between the two adjacent projections.

7. The apparatus as recited in claim 1 wherein the coating is ceramic.

8. The apparatus as recited in claim 1 further including a sprayer that sprays the coating on the airfoil.

9. The apparatus as recited in claim 1 wherein a wall is defined been two adjacent cooling slots, and each recessed portion receives one wall.

10. An apparatus for protecting a plurality of cooling slots of an airfoil comprising:

an airfoil including a plurality of cooling slots;

a shield including a plurality of projections, wherein each of the plurality of projections is received in one of the plurality of cooling slots to prevent a coating from entering the plurality of cooling slots, the shield includes a hole, and a fixture engages the hole to position the shield on the airfoil and to remove the shield from the airfoil.

11. An apparatus for protecting a plurality of cooling slots of an airfoil comprising:

an airfoil including a plurality of cooling slots, wherein the airfoil includes a pressure side and a suction side;

a shield including a plurality of projections, wherein each of the plurality of projections is received in one of the plurality of cooling slots to prevent a coating from entering the plurality of cooling slots, the shield includes a body having the plurality of projections, a flap, and a joint line having a reduced thickness between the body and the flap, and the flap is moveable relative to the body along the joint line such that the body is located proximate to the pressure side of the airfoil and the flap is located proximate to the suction side of the airfoil.

12. A shield for protecting at least one opening in a component during an operation comprising:

a body including a shield edge having a shield shape that corresponds to a component shape of a component, a plurality of projections each receivable in an opening in the component, and a recessed portion defined between two adjacent projections, wherein the recessed portion has a recessed thickness and the body and the projections have a shield thickness, and the recessed thickness is less than the shield thickness; and a flap moveable relative to the body.

13. The shield as recited in claim 12 wherein the shield includes a locating feature that locates the shield relative to the component.

14. The shield as recited in claim 12 wherein the shield further includes a recessed edge, and each recessed portion is defined between the shield edge, the recessed edge and between the two adjacent projections.

15. The shield as recited in claim 12 wherein the component is an airfoil and the at least one opening is at least one cooling slot.

16. A shield for protecting at least one opening in an airfoil during an operation comprising:

a body including a shield edge having a shield shape that corresponds to a component shape of an airfoil and at least one projection receivable in at least one opening in the airfoil, wherein the body includes a hole, and a fixture engages the hole to position the shield on the airfoil and to remove the shield from the airfoil; and a flap moveable relative to the body.

17. A shield for protecting at least one opening in an airfoil during an operation comprising:

a body including a shield edge having a shield shape that corresponds to a component shape of an airfoil and at least one projection receivable in at least one opening in the airfoil;

a flap moveable relative to the body; and a joint line having a reduced thickness located between the body and the flap, and the flap is moveable relative to the body along the joint line.

* * * * *